US005995078A

United States Patent [19]

Ellert

[11] Patent Number: 5,995,078

[45] Date of Patent: Nov. 30, 1999

[54] INCREMENTAL AUTOMATIC TRACK DATABLOCK OFFSET

[75] Inventor: James W. Ellert, Placentia, Calif.

[73] Assignee: Raytheon Company, Lexington, Mass.

[21] Appl. No.: 08/691,074

[22] Filed: Aug. 7, 1996

[51] Int. Cl.[6] ..... G09G 5/00

[52] U.S. Cl. ..... 345/113; 345/121; 345/435; 345/437

[58] Field of Search ..... 345/113, 121, 345/114, 126, 133, 433, 435, 437

[56] References Cited

U.S. PATENT DOCUMENTS 5,689,717 11/1997 Pritt ..... 345/433

*Primary Examiner*—Bipin H. Shalwala
*Assistant Examiner*—Kent Chang

[57] ABSTRACT

A method for displaying a datablock (31) on an air traffic control display system that upon each update changes a display offset angle of the datablock by a predetermined increment to either (1) rotate the offset angle toward a desired offset angle if the datablock can be displayed at the rotated offset angle without generating overlap between a padded bounding rectangle (53) of the datablock and padded bounding rectangles of any other datablocks, or (2) minimize overlap of the padded bounding rectangle of the datablock with padded bounding rectangles of other datablocks.

12 Claims, 5 Drawing Sheets

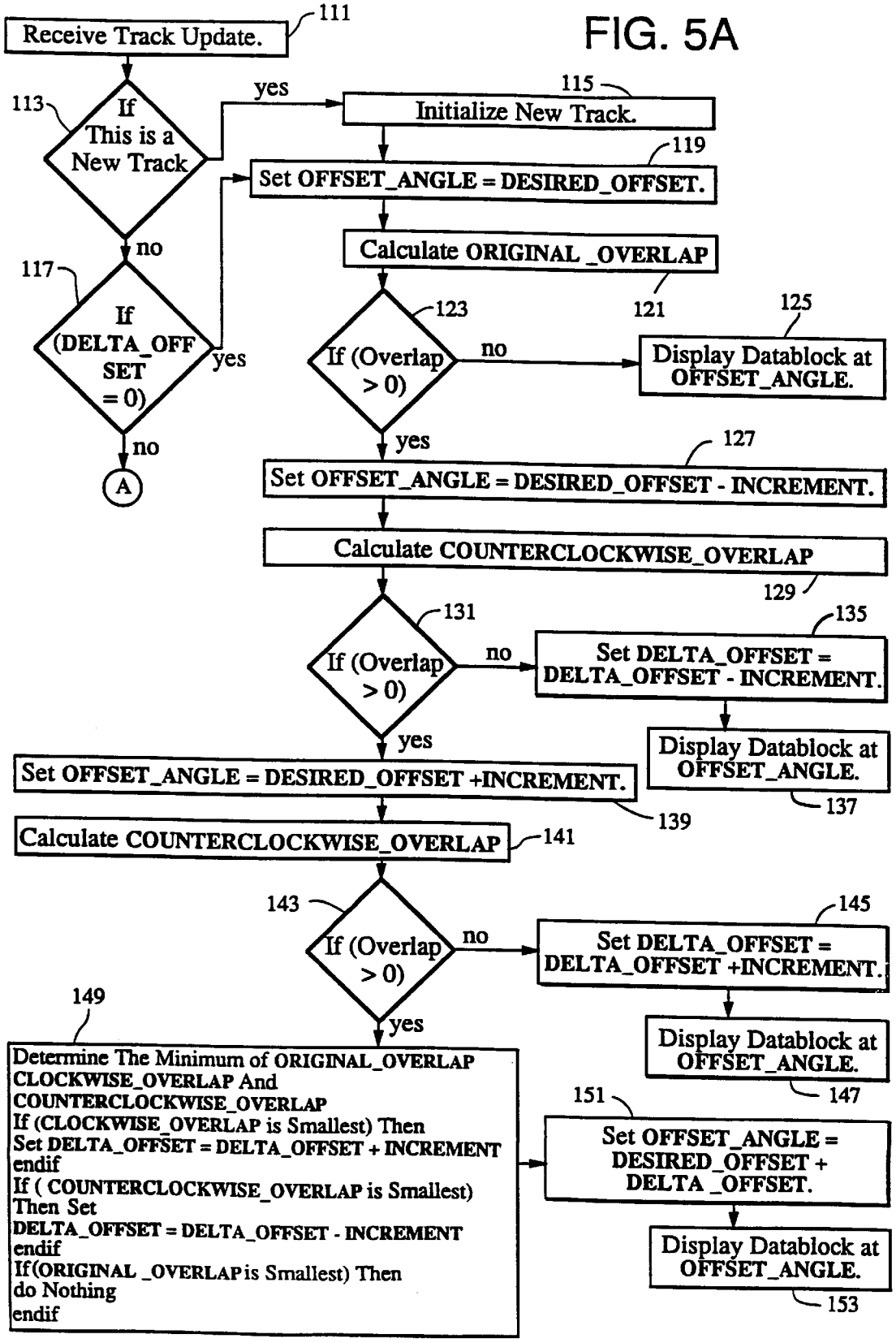
FIG. 5A
Receive Track Update.
111
113
If This is a New Track
yes
115
Initialize New Track.
119
Set OFFSET_ANGLE = DESIRED_OFFSET.
no
117
If (DELTA_OFFSET = 0)
yes
no
A
Calculate ORIGINAL _OVERLAP
121
123
If (Overlap > 0)
no
125
Display Datablock at OFFSET_ANGLE.
yes
127
Set OFFSET_ANGLE = DESIRED_OFFSET - INCREMENT.
Calculate COUNTERCLOCKWISE_OVERLAP
129
131
If (Overlap > 0)
no
135
Set DELTA_OFFSET = DELTA_OFFSET - INCREMENT.
Display Datablock at OFFSET_ANGLE.
137
yes
Set OFFSET_ANGLE = DESIRED_OFFSET +INCREMENT.
139
Calculate COUNTERCLOCKWISE_OVERLAP
141
143
If (Overlap > 0)
no
145
Set DELTA_OFFSET = DELTA_OFFSET +INCREMENT.
Display Datablock at OFFSET_ANGLE.
147
yes
149
Determine The Minimum of ORIGINAL_OVERLAP CLOCKWISE_OVERLAP And COUNTERCLOCKWISE_OVERLAP
If (CLOCKWISE_OVERLAP is Smallest) Then
Set DELTA_OFFSET = DELTA_OFFSET + INCREMENT
endif
If ( COUNTERCLOCKWISE_OVERLAP is Smallest) Then Set
DELTA_OFFSET = DELTA_OFFSET - INCREMENT
endif
If(ORIGINAL _OVERLAP is Smallest) Then
do Nothing
endif
151
Set OFFSET_ANGLE = DESIRED_OFFSET + DELTA _OFFSET.
Display Datablock at OFFSET_ANGLE.
153

INCREMENTAL AUTOMATIC TRACK DATABLOCK OFFSET

BACKGROUND OF THE INVENTION

The disclosed invention is generally directed to air traffic control display systems, and more particularly to an air traffic control display system that automatically offsets overlapping displayed datablocks.

An air traffic control situation display system generally provides a display that is basically a top plan view of aircraft traffic in a fixed geographical region. The displayed information typically includes a symbol that represents an aircraft, a symbol that represents the tracked horizontal path of the aircraft, a symbol that represents the current velocity and direction of the aircraft, and a datablock that contains textual information regarding the aircraft such as aircraft identification, current altitude, and assigned altitude.

When aircraft are close to each other, the respective datablocks may overlap and obscure each other. Current techniques detect overlap conditions and "flip" an overlapping datablock to one of four Cartesian quadrants. This large change in position of a datablock can be distracting, and moreover requires a large amount of processing to process overlaps.

SUMMARY OF THE INVENTION

It would therefore be an advantage to provide a technique for reducing overlap of datablocks in an ATC display system without distracting changes in position.

Another advantage would be to provide an efficient technique for reducing overlap of datablocks in an ATC display system.

The foregoing and other advantages are provided by the invention in a method of displaying a datablock that includes the steps of receiving a track update; and displaying a datablock of the updated track at an offset angle that is changed from an initial offset angle by a predetermined increment only if necessary to either (1) rotate the offset angle toward a desired offset angle if the datablock can be displayed at the rotated offset angle without generating overlap between a padded bounding rectangle of the datablock and padded bounding rectangles of any other datablocks, or (2) minimize overlap of the padded bounding rectangle of the datablock with padded bounding rectangles of other datablocks.

BRIEF DESCRIPTION OF THE DRAWINGS

The advantages and features of the disclosed invention will readily be appreciated by persons skilled in the art from the following detailed description when read in conjunction with the drawing wherein:

FIGS. 5A, 5B, and 5C set forth a flow diagram of a datablock display procedure in accordance with the invention.

DETAILED DESCRIPTION OF THE DISCLOSURE

Figure 1:
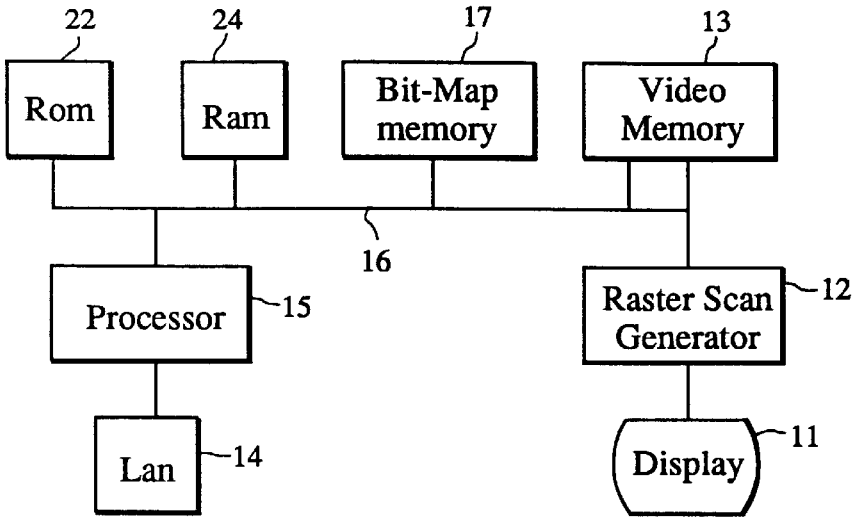
FIG. 1 is a block of an Air Traffic Control (ATC) video display system in which the invention can be incorporated.

In the following detailed description and in the several figures of the drawing, like elements are identified with like reference numerals.

Referring now to FIG. 1, set forth therein is a block diagram of an Air Traffic Control (ATC) video display system in which the invention can be incorporated, and which includes a raster scan generator 12 which converts raster image data stored in a video memory 13 to video signals that are provided to a raster video display 11 that displays a raster image that is representative of the raster image data stored in the video memory 13. In accordance with conventional display techniques, the raster video display 11 produces a visible video raster image that is comprised of an array of uniquely addressable pixels arranged in rows and columns on a screen of the video display. The image is more particularly formed by selective illumination of the pixels such that they are visible relative to background pixels which may be dark or of a predetermined color. The pixel data that defines the attributes of each pixel is stored in a corresponding memory location in the video memory 13. For convenience, the pixel data for a pixel in the raster image is sometimes called a pixel and the particular meaning of the term pixel should be understood from the context in which such term is utilized.

The raster image data contained in the video memory represents an image that is to be displayed by the video display, and is "rendered" (i.e., generated) by a processor 15, for example by executing drawing and graphical attribute instructions contained in display lists each of which contains drawing instructions for rendering a graphic object. By way of illustrative example, the processor 15 receives from a local area network (LAN) 14 radar data representative of aircraft information to be displayed, including for example position, identification number, altitude, and velocity. The radar data is processed to produce respective display lists for the graphic objects that are to be displayed, and the display lists are in turn processed to render into a bit-map memory 17 raster image data for the graphic objects. The bit-map memory 17 is of at least the same size as the video memory 13, and the rendered raster image data is then copied to the video memory 13. In accordance with conventional architectures, the display system includes a read-only memory (ROM) 22 and a random access memory (RAM) 24 which are utilized by the processor 15. The processor 15, the bit-map memory 17, the video memory 13, the ROM 22, and the RAM 24 are interconnected by a bus 16.

Figure 2:
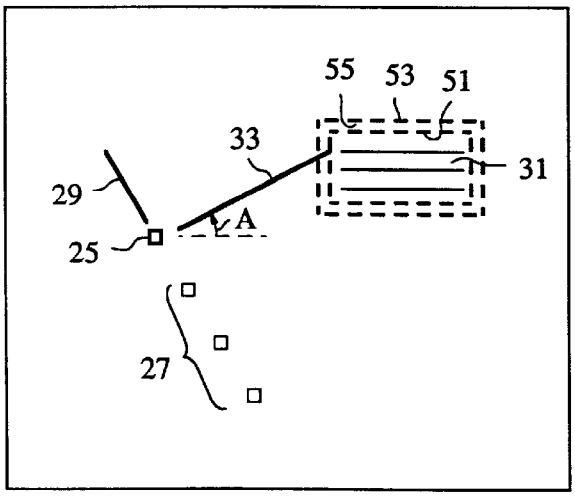
FIG. 2 is a schematic illustration of a track that would be displayed by the ATC video display system of FIG. 1.

Referring now to FIG. 2, an aircraft is represented in a raster image 21 by a "track" that includes a symbol 25 that represents the aircraft, dots 27 that represent the tracked horizontal trajectory of the aircraft, a velocity vector 29 that represents the instantaneous horizontal trajectory and velocity of the aircraft, and an alphanumerical datablock 31 that contains information about the aircraft such as call sign, current altitude and assigned altitude. A leader line 33 extends from the aircraft symbol 25 to the datablock 31, and for example is connected to the center of the aircraft symbol 25 at one end and to the center of the topmost line of alphanumeric information of the datablock 31. By way of illustrative example, the leader line 33 is drawn to the outer boundary of the aircraft symbol 25 and the outer boundary of the datablock 31, so as to avoid confusing overlap. The raster image 21 is shown without the individual pixels to avoid clutter, and it should be appreciated that the pixels of the raster image 21 would be arranged in rows and columns in accordance with conventional techniques. By way of illustrative example, each pixel has a row coordinate and a column coordinate which are referenced to an origin located at the upper left corner of the raster image 21.

The datablock 31 more particularly comprises a graphic object that is displayed pursuant to a datablock display list, while the remaining elements of the track are organized as one or more graphic objects having respective one or more display lists. Associated with the datablock 31 is an offset angle A relative to horizontal as determined by the angle of the leader line 33 relative to horizontal, and is displaced from the aircraft symbol by the length of the leader line 33.

When a track is updated pursuant to regularly received radar information, the contents of the track and the physical location of the track on the display are typically changed, consistently with the movement of the associated aircraft through the airspace represented in the display.

Further associated with the datablock 31 is a definition of a padded bounding rectangle 53 which is a rectangle that encloses (a) a bounding rectangle 51 that is the smallest rectangle that encloses all of the pixels of the raster image that are affected by the display list for the datablock 31, and (b) a predetermined padding region 55 that surrounds the bounding rectangle 51. For example, the bounding rectangle is defined by its upper left corner and its lower right corner. The row coordinate of the upper left corner of the bounding rectangle 51 corresponds to the uppermost pixel row that contains at least one pixel that is included in the displayed datablock 31 and the column coordinate of the upper left corner of the bounding rectangle 51 corresponds to the leftmost pixel column that contains a pixel that is included in the displayed datablock 31. Similarly, the row coordinate of the lower right corner of the bounding rectangle 51 corresponds to the lowermost pixel row that contains at least one pixel that is included in the displayed datablock 31, and column coordinate of the lower right corner of the bounding rectangle 51 corresponds to the rightmost pixel column that contains at least one pixel that is included in the displayed datablock 31. The padded bounding rectangle 53 is readily defined, for example by defining coordinates that are offset relative to the coordinates of the upper left corner and the lower right corner of the bounding rectangle 51. For the particular example wherein the origin of the coordinate system of the raster image 21 is to the lower left of the raster image, the upper left corner of the padded bounding rectangle can be defined by increasing the row coordinate and decreasing the column coordinate of the upper left corner of the bounding rectangle, and the lower right corner of the padded bounding rectangle can be defined by decreasing the row coordinate and increasing the column coordinate of the lower right corner of the bounding rectangle.

Since the padded bounding rectangle 53 is expressed in coordinates of the coordinate system of the raster image 21, the padded bounding rectangle 53 effectively defines an area in which the datablock 31 is to be displayed. Also, whether padded bounding rectangles of respective datablocks overlap can be readily determined from the respective coordinates thereof. Such overlap is indicative of the proximity of the respective datablocks if such datablocks are to be displayed.

In accordance with the invention, when a track is updated or initially generated, for example pursuant to a radar update, the datablock for the updated track is displayed at an offset angle that is (a) equal to an initial offset angle, (b) equal to the initial offset angle and an angular increment in a clockwise direction, or (c) equal to the initial offset angle and the angular increment in a counterclockwise direction, depending on whether the offset angle can be moved by the angular increment toward a user specified desired angular offset without creating overlap of the padded bounding rectangle of the datablock with padded bounding rectangles of other datablocks, or depending on which offset angle eliminates or minimizes overlap of the padded bounding rectangle of the datablock with padded bounding rectangles of other datablocks. In particular, if the initial offset angle is not equal to the user specified desired offset angle, and if the offset angle can be moved by the angular increment toward a user specified desired angular offset without creating overlap, the datablock is displayed at the offset angle that is closer to the user specified desired angle relative to the initial offset angle by the predetermined angular increment. If the initial offset angle is equal to the desired offset angle, and if display of the datablock at the initial offset angle would not produce any overlap, the datablock is displayed at the initial offset angle. If the initial offset angle is not equal to the desired offset angle and overlap would be generated by display of the datablock at an offset angle that is rotated toward the desired offset angle by the predetermined increment, or if the initial offset angle is equal to the desired offset and overlap would be generated by display of the datablock at the initial offset angle, the datablock is displayed at one of the following offset angles: (a) an offset angle that is equal to the initial offset angle, (b) an offset angle that is equal to the initial offset angle and the predetermined angular increment in a clockwise direction, or (c) an offset angle that is equal to the initial offset angle and the predetermined angular increment in a counterclockwise direction, whichever eliminates overlap or provides for the least overlap. The initial offset angle is the offset angle for an earlier version of the datablock 31 if the updated track is an existing track, or is the desired offset angle if the updated track is a new track.

Figure 3:
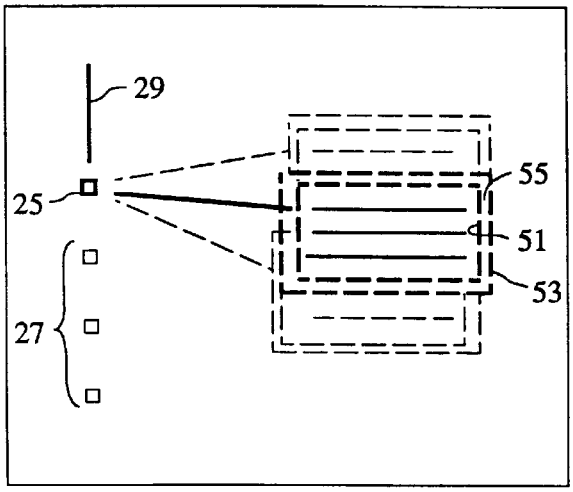
FIG. 3 is a schematic illustration of the offset angles at which a datablock of a track would be displayed in accordance with the invention.

Thus, in accordance with the invention, the offset angle of a datablock can be changed at each update only by the predetermined increment relative to the initial offset angle of the updated datablock, and such change is in a direction that tends to restore the offset angle to a desired offset angle so long as overlap is avoided, or to minimize overlap. In particular, the offset angle for a datablock can be changed at each update only by an incremental value, but only if (1) the initial offset angle is not equal to the desired offset angle and an incremental change in the offset angle toward the desired offset angle and does not create overlap; or (2) the incremental change eliminates or minimizes overlap. FIG. 3 schematically illustrates the offset angles at which a datablock can be displayed pursuant to a track update, wherein display of the datablock at the initial offset angle is shown in solid lines.

Figure 4A:
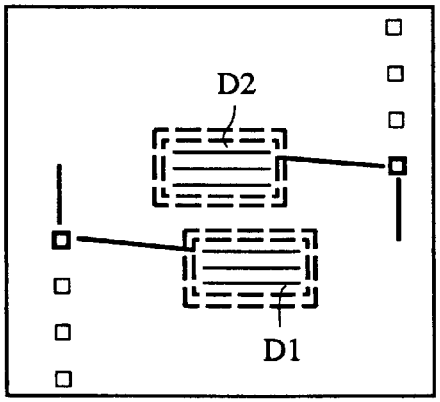
FIGS. 4A, 4B, 4C, 4D, 4E and 4F set forth a sequence of schematic images that illustrate the changes in offset angles of datablocks D1 and D2 as their associated tracks move pursuant to updates.
Figure 4B:
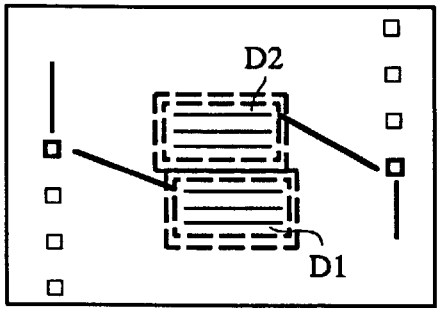
Figure 4C:
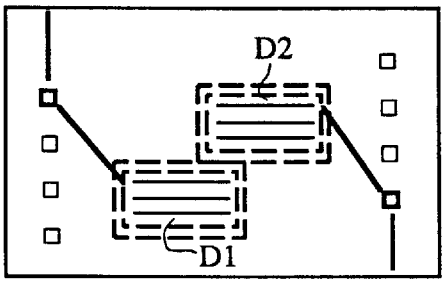
Figure 4D:
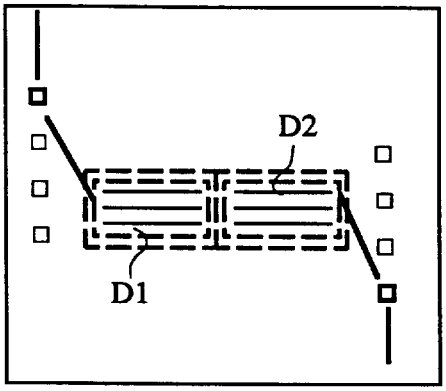
Figure 4E:
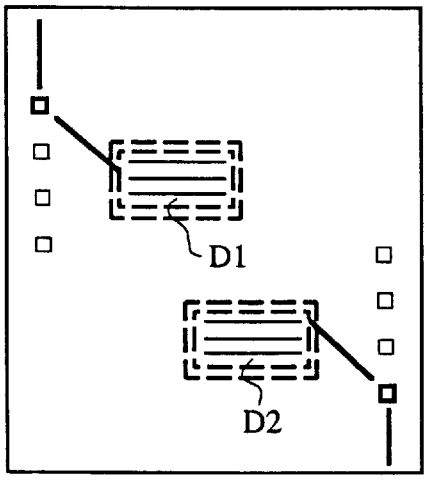
Figure 4F:
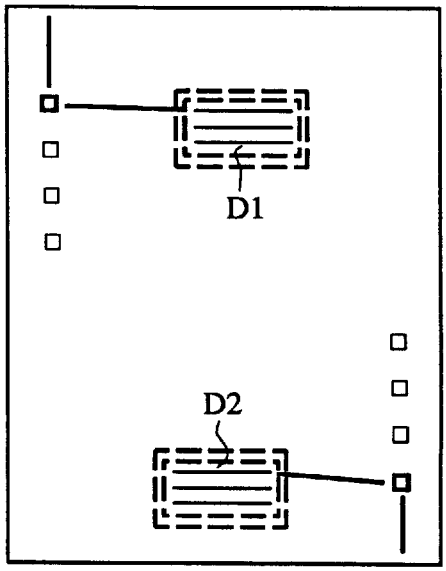

FIGS. 4A, 4B, 4C, 4D, 4E, and 4F set forth a sequence of schematic images that illustrate the changes in offset angles of datablocks D1 and D2 as their associated tracks move pursuant to updates. The track associated with the datablock D1 is moving upward in the display while the track associated with the datablock D2 is moving downward in the display. FIG. 4A, shows the offset angles at the user specified desired offset angles. FIGS. 4B–4E show the offset angles as changed to prevent overlap. FIG. 4F shows the offset angles as restored to the desired offset angles.

Figure 5B:
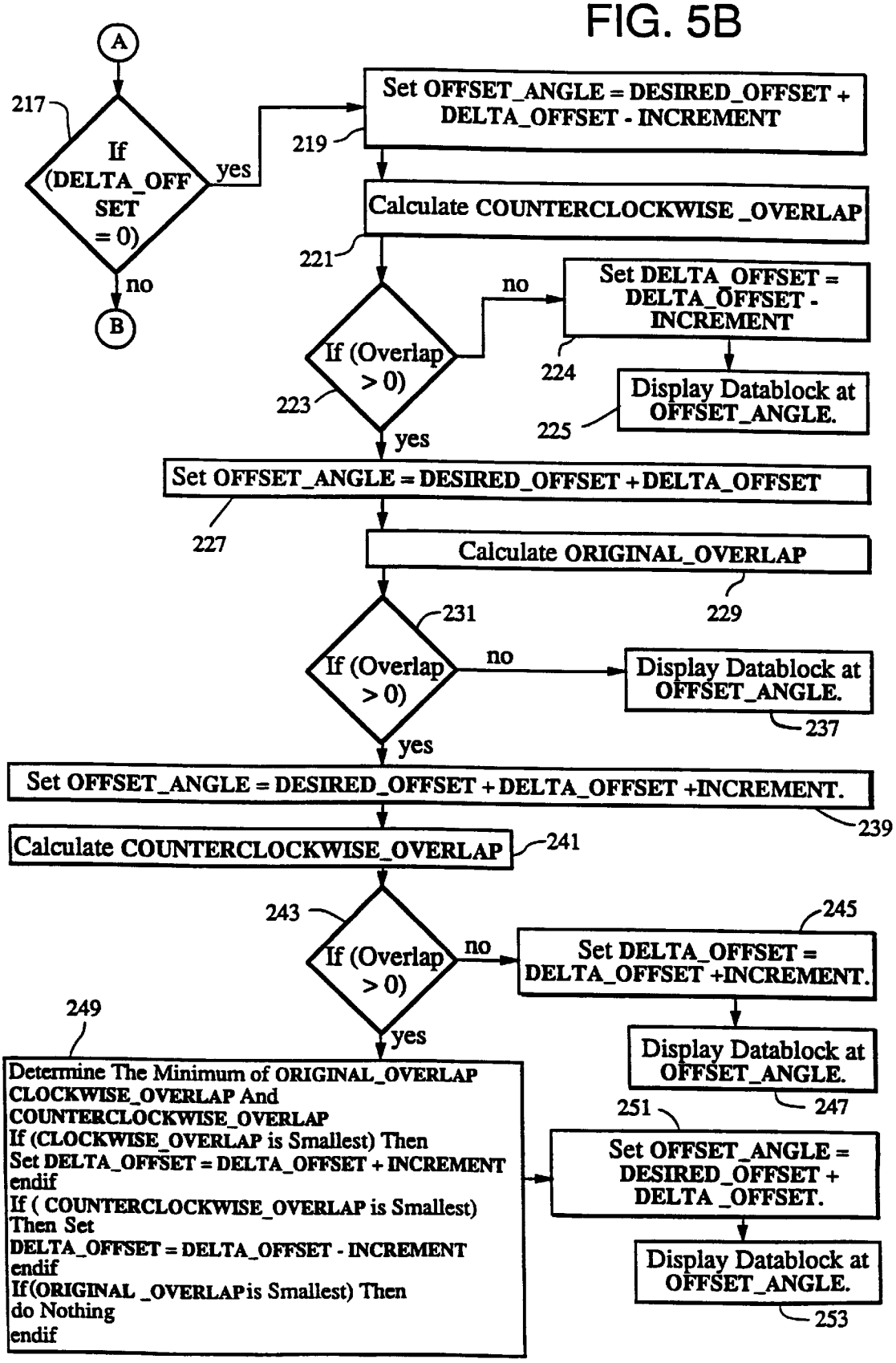
Figure 5C:
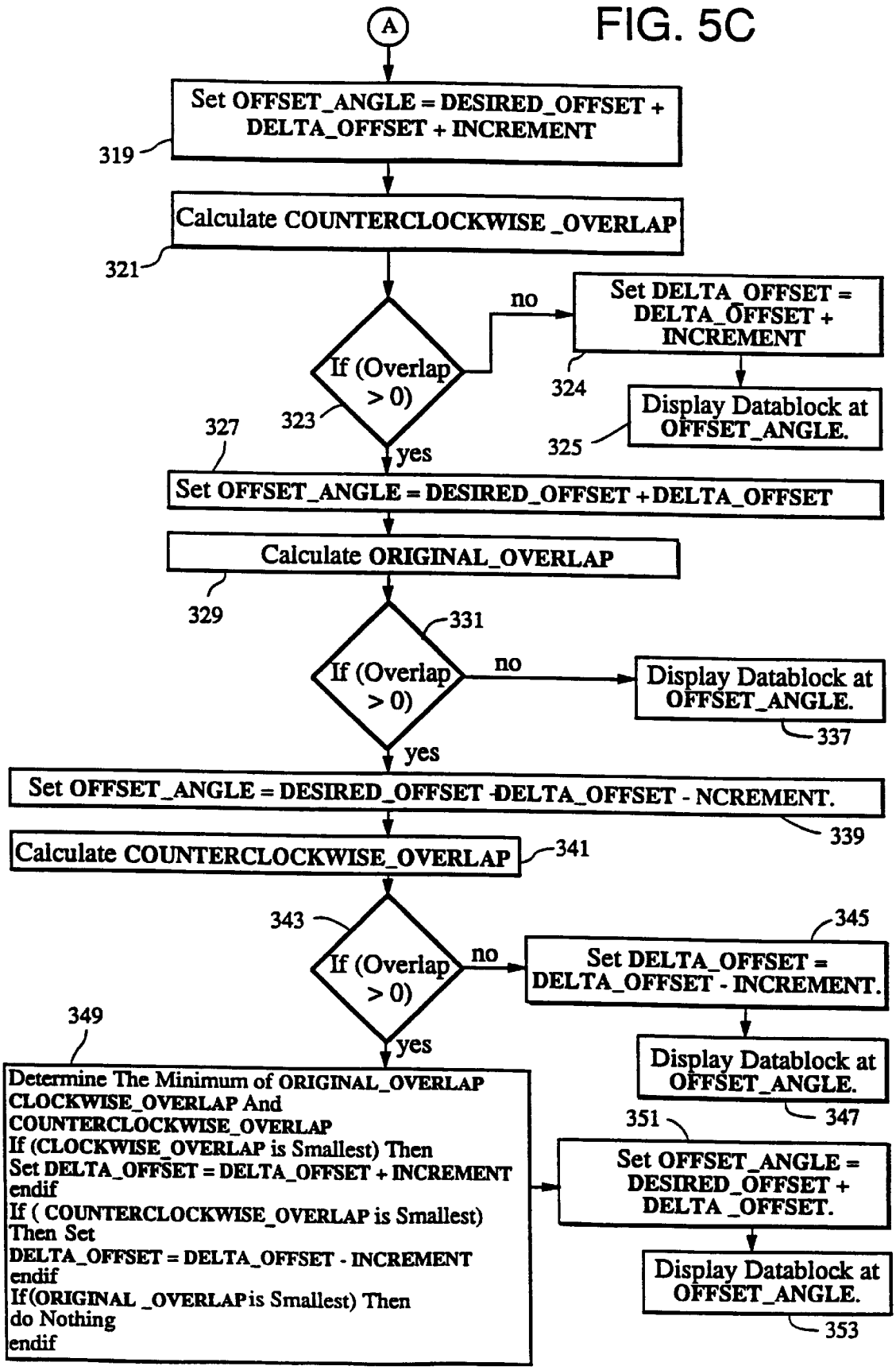

Referring now to FIGS. 5A, 5B, and 5C, set forth therein is a flow diagram that sets forth a procedure for calculating an offset angle for a datablock that will reduce overlap between datablocks of an ATC situation display system in accordance with the invention. The variables utilized in the procedure include OFFSET_ANGLE which is the offset angle associated with the datablock, DESIRED_OFFSET which is the desired offset angle requested by the user, DELTA_OFFSET which is the offset of the OFFSET_ANGLE relative to DESIRED_OFFSET, and INCREMENT which is the incremental value by which the offset angle can be changed at each track update. By way of illustrative example, angle increases in the clockwise direction.

At 111 a track update is received. At 113 a determination is made as to whether the track update is a new track. If yes, at 115 a new track is initialized whereby appropriate display lists for display of the new track are generated, DESIRED_OFFSET is initialized to an appropriate value, and DELTA_OFFSET is initialized to 0. Control then transfers from 115 to 117. If the determination at 113 is no, at 117 a determination is made as to whether the present value of DELTA_OFFSET is zero. If yes, at 119 OFFSET_ANGLE is set to DESIRED_OFFSET+DELTA_OFFSET. At 121 a calculation is made as to the overlap area ORIGINAL_OVERLAP of the padded bounding rectangle for the datablock, as positioned at the current OFFSET_ANGLE calculated at 119, with any padded bounding rectangles of displayed datablocks. At 123 a determination is made as to whether ORIGINAL_OVERLAP is greater than zero. If no, at 125 the datablock is displayed, and the procedure ends.

If the determination at 123 is yes, at 127 OFFSET_ANGLE is set to DESIRED_OFFSET—INCREMENT, which is an offset angle that is rotated counterclockwise from DESIRED_OFFSET by INCREMENT. At 129 a calculation is made as to the overlap area COUNTERCLOCKWISE_OVERLAP of the padded bounding rectangle for the datablock, as positioned at the current OFFSET_ANGLE calculated at 127, with any padded bounding rectangles of displayed datablocks. At 131 a determination is made as to whether COUNTERCLOCKWISE_OVERLAP is greater than zero. If no, at 135 DELTA_OFFSET is set to DELTA_OFFSET—INCREMENT; and at 137 the datablock is displayed at the current value of OFFSET_ANGLE as calculated at 127.

If the determination at 131 is yes, at 139 OFFSET_ANGLE is set to DESIRED_OFFSET+INCREMENT, which is an offset angle that is rotated clockwise from DESIRED_OFFSET by INCREMENT. At 141 a calculation is made as to the overlap area CLOCKWISE_OVERLAP of the padded bounding rectangle for the datablock, as positioned at the current OFFSET_ANGLE calculated at 139, with any padded bounding rectangles of displayed datablocks. At 143 a determination is made as to whether CLOCKWISE_OVERLAP is greater than zero. If no, at 145 DELTA_OFFSET is set to DELTA_OFFSET+INCREMENT; and at 147 the datablock is displayed at the current value of OFFSET_ANGLE as calculated at 139.

If the determination at 143 is yes, at 149 the least or minimum of ORIGINAL_OVERLAP, COUNTERCLOCKWISE_OVERLAP and CLOCKWISE_OVERLAP_AREA is determined, and DELTA_OFFSET is set as follows:

(a) If CLOCKWISE_OVERLAP is smallest, then DELTA_OFFSET is set to DELTA_OFFSET+INCREMENT.

(b) If COUNTERCLOCKWISE_OVERLAP is smallest, then DELTA_OFFSET is set to DELTA_OFFSET—INCREMENT.

(c) If ORIGINAL_OVERLAP is smallest, then DELTA_OFFSET is not changed.

At 151 OFFSET_ANGLE is set equal to DESIRED_OFFSET+DELTA_OFFSET, and at 153 the datablock is displayed at the OFFSET_ANGLE as calculated at 151.

If the determination at 117 is no, at 217 a determination is made as to whether the present value of DELTA_OFFSET is greater than zero. If yes, at 219 OFFSET_ANGLE is set to DESIRED_OFFSET+DELTA_OFFSET INCREMENT, which is an offset angle that is rotated counterclockwise from DESIRED_OFFSET+DELTA_OFFSET by INCREMENT and thus toward DESIRED_OFFSET. At 221 a calculation is made as to the overlap area COUNTERCLOCKWISE_OVERLAP of the padded bounding rectangle for the datablock, as positioned at the current OFFSET_ANGLE calculated at 219, with any padded bounding rectangles of displayed datablocks. At 223 a determination is made as to whether COUNTERCLOCKWISE_OVERLAP is greater than zero. If no, at 224 DELTA_OFFSET is set to DELTA_OFFSET—INCREMENT; and at 225 the datablock is displayed at the current value of OFFSET_ANGLE as calculated at 219.

If the determination at 223 is yes, at 227 OFFSET_ANGLE is set to the sum of the present values of DESIRED_OFFSET and DELTA_OFFSET. At 229 a calculation is made as to the overlap area ORIGINAL_OVERLAP of the padded bounding rectangle for the datablock, as positioned at the current OFFSET_ANGLE calculated at 227, with any padded bounding rectangles of displayed datablocks. At 231 a determination is made as to whether ORIGINAL OVERLAP is greater than zero. If no, at 237 the datablock is displayed, and the procedure ends.

If the determination at 231 is yes, at 239 OFFSET_ANGLE is set to DESIRED_OFFSET+DELTA_OFFSET+INCREMENT, which is an offset angle that is rotated clockwise from DESIRED_OFFSET+DESIRED_OFFSET by INCREMENT. At 241 a calculation is made as to the overlap area CLOCKWISE_OVERLAP of the padded bounding rectangle for the datablock, as positioned at the current OFFSET_ANGLE calculated at 239, with any padded bounding rectangles of displayed datablocks. At 243 a determination is made as to whether COUNTERCLOCKWISE_OVERLAP is greater than zero. If no, at 245 DELTA_OFFSET is set to DELTA_OFFSET+INCREMENT; and at 247 the datablock is displayed at the current value of OFFSET_ANGLE as calculated at 239.

If the determination at 243 is yes, at 249 the least or minimum of ORIGINAL_OVERLAP, COUNTERCLOCKWISE_OVERLAP and CLOCKWISE_OVERLAP_AREA is determined, and DELTA_OFFSET is set as follows:

(a) If CLOCKWISE_OVERLAP is smallest, then DELTA_OFFSET is set to DELTA_OFFSET+INCREMENT.

(b) If COUNTERCLOCKWISE OVERLAP is smallest, then DELTA_OFFSET is set to DELTA_OFFSET—INCREMENT.

(c) If ORIGINAL_OVERLAP is smallest, then DELTA_OFFSET is not changed.

At 251 OFFSET_ANGLE is set equal to DESIRED OFFSET+DELTA_OFFSET, and at 253 the datablock is displayed at the OFFSET_ANGLE as calculated at 251.

If the determination at 217 is no, at 319 OFFSET_ANGLE is set to DESIRED_OFFSET+DELTA_OFFSET+INCREMENT, which is an offset angle that is rotated clockwise from DESIRED_OFFSET+DELTA_OFFSET by INCREMENT and thus toward DESIRED_OFFSET. At 321 a calculation is made as to the overlap area CLOCKWISE_OVERLAP of the padded bounding rectangle for the datablock, as positioned at the current OFFSET_ANGLE calculated at 319, with any padded bounding rectangles of displayed datablocks. At 323 a determination is made as to whether CLOCKWISE_OVERLAP is greater than zero. If no, at 324 DELTA_OFFSET is set to DELTA_OFFSET+INCREMENT; and at 325 the datablock is displayed at the current value of OFFSET_ANGLE as calculated at 319.

If the determination at 323 is yes, at 327 OFFSET_ANGLE is set to the sum of the present values of DESIRED_OFFSET and DELTA_OFFSET. At 329 a calculation is made as to the overlap area ORIGINAL_OVERLAP of the padded bounding rectangle for the datablock, as positioned at the current OFFSET_ANGLE calculated at 327, with any padded bounding rectangles of displayed datablocks. At 331 a determination is made as to whether ORIGINAL_OVERLAP is greater than zero. If no, at 337 the datablock is displayed, and the procedure ends.

If the determination at 331 is yes, at 339 OFFSEThd—ANGLE is set to DESIRED_OFFSET+DELTA_OFFSET INCREMENT, which is an offset angle that is rotated counterclockwise from DESIRED_OFFSET+DESIRED_OFFSET by INCREMENT. At 341 a calculation is made as to the overlap area COUNTERCLOCKWISE_OVERLAP of the padded bounding rectangle for the datablock, as positioned at the current OFFSET_ANGLE calculated at 339, with any padded bounding rectangles of displayed datablocks. At 343 a determination is made as to whether COUNTERCLOCKWISE_OVERLAP is greater than zero. If no, at 345 DELTA_OFFSET is set to DELTA_OFFSET—INCREMENT; and at 347 the datablock is displayed at the current value of OFFSET_ANGLE as calculated at 339.

If the determination at 343 is yes, at 349 the least or minimum of ORIGINAL_OVERLAP, COUNTERCLOCKWISE_OVERLAP and CLOCKWISE_OVERLAP is determined, and DELTA_OFFSET is set as follows:

(a) If CLOCKWISE_OVERLAP is smallest, then DELTA_OFFSET is set to DELTA_OFFSET+INCREMENT.

(b) If COUNTERCLOCKWISE_OVERLAP is smallest, then DELTA_OFFSET is set to DELTA_OFFSET—INCREMENT.

(c) If ORIGINAL_OVERLAP is smallest, then DELTA_OFFSET is not changed.

At 351 OFFSET_ANGLE is set equal to DESIRED_OFFSET+DELTA_OFFSET, and at 353 the datablock is displayed at the OFFSET_ANGLE as calculated at 351.

The foregoing has thus been a disclosure of an efficient technique for reducing overlap of datablocks in an ATC video display system that advantageously avoids distracting changes in position and tends to restore the angular position of a datablock to a desired angular position.

Although the foregoing has been a description and illustration of specific embodiments of the invention, various modifications and changes thereto can be made by persons skilled in the art without departing from the scope and spirit of the invention as defined by the following claims.

What is claimed is:

1. A method for displaying a graphic object (13) on a video display, the graphic object having associated therewith an initial offset angle and a desired offset angle, and further having associated therewith a padded bounding rectangle (53) that represents an area on the display in which the graphic object would be displayed, comprising the steps of (A) receiving an update for a track associated with the datablock;

(B) if the initial offset angle of the graphic object is equal to the desired offset angle, displaying the graphic at the initial offset angle if no overlap is generated between the padded bounding rectangle of the graphic object and a padded bounding rectangle of any other graphic object;

(C) if the initial offset angle of the graphic object is not equal to the desired offset angle, displaying the graphic object at an offset angle that is rotated by a predetermined increment toward a desired offset angle if no overlap is generated between the padded bounding rectangle of the graphic object and a padded bounding rectangle of any other graphic object; and (D) if the graphic object is not displayed pursuant to one of the steps (B) and (C), displaying the graphic object at a selected one of the following offset angles that minimizes overlap between the padded bounding rectangle of the graphic object and padded bounding rectangles of any other graphic objects: (a) an offset angle that is equal to an initial offset angle, (b) an offset angle that is rotated by the predetermined increment in a first angular direction relative to the initial offset angle, and (c) an offset angle that is rotated by the predetermined increment in a second angular direction relative to the initial offset angle;

wherein the initial offset angle is the offset angle for an earlier version of the datablock and the updated track is an existing track and wherein the offset angle of the datablock can be changed at each update only by the predetermined increment relative to the initial offset angle of the updated datablock, and said change is in a direction that tends to restore the offset angle to a desired offset angle so long as overlap is avoided, or to minimize overlap.

2. A method for displaying a datablock (31) on a video display (11) of an air traffic control system, the datablock having associated therewith an offset angle, an initial offset angle and a desired offset angle, and further having associated therewith a padded bounding rectangle (53) that represents an area on the display in which the datablock would be displayed, comprising the steps of:

(A) receiving an update for a track associated with the datablock;

(B) if the initial offset angle of the datablock is equal to the desired offset angle, displaying the datablock at the initial offset angle if no overlap is generated between the padded bounding rectangle of the datablock and a padded bounding rectangle of any other datablock;

(C) if the initial offset angle of the datablock is not equal to the desired offset-angle, displaying the datablock at an offset angle that is rotated by a predetermined increment toward a desired offset angle if no overlap is generated between the padded bounding rectangle of the datablock and a padded bounding rectangle of any other datablock; and (D) if the datablock is not displayed pursuant to one of the steps (B) and (C), displaying the datablock at whichever one of the following offset angles minimizes overlap between the padded bounding rectangle of the graphic object and padded bounding rectangles of any other datablocks: (a) an offset angle that is equal to an initial offset angle, (b) an offset angle that is rotated by the predetermined increment in a first angular direction relative to the initial offset angle, and (c) an offset angle that rotated by the predetermined increment in a second angular direction relative to the initial offset angle;

wherein the initial offset angle is the offset angle for an earlier version of the datablock and the updated track is an existing track, and wherein the offset angle of the datablock can be changed at each update only by the predetermined increment relative to the initial offset angle of the updated datablock, and said change is in a direction that tends to restore the offset angle to a desired offset angle so long as overlap is avoided, or to minimize overlap.

3. The method of claim 1 wherein said first angular direction is a clockwise direction, and said second angular direction is a counterclockwise direction.

4. The method of claim 2 wherein said first angular direction is a clockwise direction, and said second angular direction is a counterclockwise direction.

5. A method for displaying a graphic object on a video display, the graphic object having associated therewith an initial offset angle and a desired offset angle, and further having associated therewith a padded bounding rectangle that represents an area on the display in which the graphic object would be displayed, the method comprising, when a track is updated or initially generated, the steps of:

determining whether the initial offset angle equals the desired offset angle, and if so, whether display of the datablock at the initial offset angle would create overlap of the padded bounding rectangle of the datablock with padded bounding rectangles of other datablocks;

displaying the datablock at the initial offset angle if the initial offset angle equals the desired offset angle and if no overlap is created;

if display of the datablock at the initial offset angle would create overlap, determining whether the offset angle can be moved by an angular increment in a first angular direction to a first moved offset angle (A) without creating overlap of the padded bounding rectangle of the datablock with padded bounding rectangles of other datablocks;

displaying said datablock at said first moved offset angle in said first angular direction if no overlap is created;

if display of the datablock at the first moved offset angle would create overlap, determining whether the offset angle can be moved by an angular increment in a second angular direction to a second moved offset angle (B) without creating overlap of the padded bounding rectangle of the datablock with padded bounding rectangles of other datablocks;

displaying said datablock at said second moved offset angle in said second angular direction if no overlap is created;

if the offset angle cannot be moved by the angular increment in either said first angular direction or said second angular direction without creating overlap, determining which of said initial offset angle, said moved offset angle (A) and said moved offset angle (B) minimizes overlap of the padded bounding rectangle of the datablock with padded bounding rectangles of other datablocks and displaying said datablock at said offset angle which minimizes overlap;

wherein the initial offset angle is the offset angle for an earlier version of the datablock and the updated track is an existing track, and wherein the offset angle of the datablock can be changed at each update only by the predetermined increment relative to the initial offset angle of the updated datablock, and said change is in a direction that tends to restore the offset angle to a desired offset angle so long as overlap is avoided, or to minimize overlap.

6. The method of claim 5 wherein said first angular direction is a clockwise direction, and said second angular direction is a counterclockwise direction.

7. An air traffic control video display system, comprising:

memory apparatus for storing raster image data;

a raster scan generator for converting the raster image data stored in said memory apparatus into video signals;

a raster video display responsive to the video signals for producing a visible video raster image comprising an array of uniquely addressable pixels;

a data source for providing radar data representative of aircraft information to be displayed;

a processor responsive to the radar data and coupled to the memory apparatus and the raster scan generator for processing the radar data to provide track information about aircraft to display a symbol for each aircraft representing that aircraft and a datablock, said datablock having associated therewith an offset angle, an initial offset angle, a desired offset angle and a padded bounding rectangle representing an area on the display in which the datablock would be displayed, said processor further comprising:

means for receiving from said source a data update for a track associated with the datablock;

first processing means for updating said track information to display the datablock at the initial offset angle if no overlap is generated between the padded bounding rectangle of the datablock and a padded bounding rectangle of any other datablock and if the initial offset angle of the datablock is equal to the desired offset angle;

second processing means for updating said track information to display the datablock at an offset angle that is rotated by a predetermined increment toward a desired offset angle if the initial offset angle of the datablock is not equal to the desired offset angle and if no overlap is generated between the padded bounding rectangle of the datablock and a padded bounding rectangle of any other datablock; and third processing means operable only if the datablock is not displayed pursuant to one of the first processing means and the second processing means for updating said track information to display the datablock at an offset angle displaying the datablock at whichever one of the following offset angles minimizes overlap between the padded bounding rectangle of the graphic object and padded bounding rectangles of any other datablocks: (a) an offset angle that is equal to an initial offset angle, (b) an offset angle that is rotated by the predetermined increment in a first angular direction relative to the initial offset angle, and (c) an offset angle that is rotated by the predetermined increment in a second angular direction relative to the initial offset angle;

wherein the initial offset angle is the offset angle for an earlier version of the datablock and the updated track is an existing track, and wherein the first processing means, the second processing means and the third processing means are adapted such that the offset angle of the datablock can be changed at each update only by the predetermined increment relative to the initial offset angle of the updated datablock, and said change is in a direction that tends to restore the offset angle to a desired offset angle so long as overlap is avoided, or to minimize overlap.

8. The system of claim 7 wherein said processor further includes processing apparatus for producing respective display lists for each aircraft and for rendering the display lists into raster image data for the aircraft.

9. The system of claim 7 wherein said first angular direction is a clockwise direction, and said second angular direction is a counterclockwise direction.

10. A method for displaying a datablock on a video display of an air traffic control system, the datablock having associated therewith an initial offset angle and a desired offset angle, and further having associated therewith a padded bounding rectangle that represents an area on the display in which the graphic object would be displayed, the method comprising the steps of:

receiving an update for a track associated with the datablock;

determining whether the initial offset angle equals the desired offset angle, and if so, whether display of the datablock at the initial offset angle would create overlap of the padded bounding rectangle of the datablock with padded bounding rectangles of other datablocks;

displaying the datablock at the initial offset angle if the initial offset angle equals the desired offset angle and if no overlap is created;

if display of the datablock at the initial offset angle would create overlap, determining whether the offset angle can be moved by an angular increment in a first angular direction to a first moved offset angle (A) without creating overlap of the padded bounding rectangle of the datablock with padded bounding rectangles of other datablocks;

displaying said datablock at said first moved offset angle in said first angular direction if no overlap is created;

if display of the datablock at the first moved offset angle would create overlap, determining whether the offset angle can be moved by an angular increment in a second angular direction to a second moved offset angle (B) without creating overlap of the padded bounding rectangle of the datablock with padded bounding rectangles of other datablocks;

displaying said datablock at said second moved offset angle in said second angular direction if no overlap is created;

if the offset angle cannot be moved by the angular increment in either said first angular direction or said second angular direction without creating overlap, determining which of said initial offset angle, said moved offset angle (A) and said moved offset angle (B) minimizes overlap of the padded bounding rectangle of the datablock with padded bounding rectangles of other datablocks and displaying said datablock at said offset angle which minimizes overlap;

wherein the initial offset angle is the offset angle for an earlier version of the datablock and wherein the offset angle of the datablock can be changed at each update only by the predetermined increment relative to the initial offset angle of the updated datablock, and said change is in a direction that tends to restore the offset angle to a desired offset angle so long as overlap is avoided, or to minimize overlap.

11. The method of claim 10 further including the steps of producing respective display lists for each aircraft being tracked by the air traffic control system, and rendering the display lists into raster image data for the aircraft.

12. The method of claim 10 wherein said first angular direction is a clockwise direction, and said second angular direction is a counterclockwise direction.

* * * * *